US005191310A

United States Patent [19]

Obermann et al.

[11] Patent Number: 5,191,310

[45] Date of Patent: Mar. 2, 1993

[54] ADJUSTABLE CYCLING SWITCH FOR ELECTRIC RANGE

[75] Inventors: George Obermann, Niles; Paul H. Tuma, Lombard; Ronald S. Joyce, Elk Grove Village, all of Ill.

[73] Assignee: Eaton Corporation, Cleveland, Ohio

[21] Appl. No.: 911,234

[22] Filed: Jul. 9, 1992

[51] Int. Cl.[5] ..... H01H 61/02; H01H 71/16

[52] U.S. Cl. ..... 337/105; 337/57; 337/82; 337/103

[58] Field of Search ..... 337/102, 103, 105, 107, 337/82, 93, 94, 51, 52, 53, 57; 219/507, 514, 511

[56] References Cited

U.S. PATENT DOCUMENTS 4,206,344 6/1980 Fischer et al. ..... 219/507
4,704,595 11/1987 Essig et al. ..... 337/107
5,021,762 6/1991 Hetrick ..... 337/103

*Primary Examiner*—Harold Broome
*Attorney, Agent, or Firm*—R. A. Johnston

[57] ABSTRACT

A thermally responsive load cycling switch assembly user adjustable for varying the time of cycling current to load connecting terminals and having a contact blade cantilevered from an insulator block pivoted in the switch housing. A bimetal blade actuator means is also cantilevered from the block and includes heater means to cause the bimetal to effect movement of the contact blade. A separate blade spring cantilevered from the block enables the block to be pivotably preloaded. A spring blade is cantilevered from the actuator means to enable separate preloading of the bi-metal for temperature calibration. A flexible jumper blade connects the contact blade to one of two load terminal connectors for series and parallel operation. A manually operated arming switch is series connected between one powerline terminal and one of the load terminals. A stationary contact disposed for closing a circuit with the contact blade is connected to the opposite powerline terminal. The block, contact blade, actuator means including bi-metal, heater, and the calibration spring jumper are assembled as a unit and pivoted in the housing. The terminal connectors are integrally formed with offset tabs for insertion and snap locking in grooves in the housing.

25 Claims, 5 Drawing Sheets

ADJUSTABLE CYCLING SWITCH FOR ELECTRIC RANGE

BACKGROUND OF THE INVENTION

The present invention relates to user adjustable controls for controlling the temperature of an electric range heater or "burner" as they are often called. Adjustable controls of the aforesaid type which usually cycle power to the electric burner for regulating the effective cooking temperature; and, such controls are sometimes referred to as "infinite switches". Devices of this type typically permit the range user to select an infinite number of positions of the control between a minimum and maximum setting for varying the cycling time of the burner current switch. In the more common range designs the user adjustable range burner current cycling switches employ a thermally responsive bimetal actuator which is heated typically by a heater coil which, upon flow of current therethrough for a desired time, causes the bimetal to be thermally warped and to effect opening of a switch carrying the load current.

Heretofore, the so-called infinite switches of the aforesaid type have included a separate series connected on/off or arming, switch manually actuated by the user's turning of a control knob mounted on a shaft with a cam thereon for actuating the arming switch. The entire switch assembly including the arming switch is typically encased in a housing with the shaft protruding therefrom to enable the switch assembly to be installed from behind a control panel on the range with the knob thereafter assembled over the shaft as it protrudes through the panel. Initial rotation of the knob by the user closes the arming switch and subsequent rotation positions the shaft to vary the deflection of a spring which applies an appropriate preload on the thermally responsive switch actuator for setting of the desired amount of cycling of the burner control switch.

Heretofore, the requirement that the range burner control switch assembly be mounted behind the range control panel has required that the burner control switch assembly be compact as well as electrically insulated to minimize the hazard of electrical shock from the 240 volt AC power supply to the range. Providing such a compact range burner control switch assembly capable of high volume mass production has resulted in the various components of the switch assembly being installed, assembled, and electrically connected individually within the switch housing and has resulted in undesirably high manufacturing costs and difficult assembly operations in mass production of the switch assemblies. It has therefore been desired to provide a range burner control switch assembly which is easy to assemble and calibrate and provides for low manufacturing cost.

SUMMARY OF THE INVENTION

The present invention provides a thermally actuated cycling switch for an electric range burner which is user adjustable for varying the cycling frequency of the thermally actuated switch, and includes a line power switch also actuated by the same user input of rotating a knob on a shaft extending outwardly from the switch assembly housing. The user input shaft contains a first cam which actuates the line switch and another cam which changes the deflection of the preload spring which is attached to the thermally actuated switch. A separate calibration spring attached to the thermally actuated switch is adjustable at factory assembly for calibrating the thermally actuated switch.

The switch assembly housing has a first terminal extending outwardly therefrom adapted for attachment to one side of the power line; and, the first terminal is thus connected in the housing to a stationary contact forming one side of the burner control switch. A second terminal in the housing is adapted for external connection to the opposite side of the power line, and is connected to the movable blade of the line power switch, which makes and breaks a circuit with a contact provided on a third terminal provided in the housing and adapted for connection to one side of the load or electric burner. A fourth terminal provided in the housing is adapted for connection to the opposite side of the load or burner.

The thermally actuated switch assembly is built up as subassembly on an insulator block which has the preload spring extending therefrom in cantilever for contacting one of the cams on the user input shaft. The preload spring preferably has an ambient temperature compensating bimetal construction. The block also has a thermal actuator comprising a bimetal arm extending in cantilever from the block with a heater provided thereon; and, a spring loaded jumper extends between the pivot block and the heater to provide for electrical connection to the heater. A flexible jumper is attached to the pivot block for electrical connection to at least one of the third and fourth housing terminals. The subassembly of the pivot block preload spring, bimetal arm, heater and heater jumper is installed as a unit upon pivoting of the blocks to the housing, whereupon the preload spring engages the cam on the user input shaft; and, the jumper is attached to at least one of the third and fourth terminals. In one embodiment, the subassembly includes a snap acting switch blade actuated by the bimetal; and, in another arrangement, the movable switch contact for the burner control is mounted directly to the bimetal arm. Either type of switch arrangement may be connected in series or parallel with the load by providing a second jumper from the pivot block to the remaining one of the third and fourth housing terminal.

In another aspect of the invention, the powerline and load connector terminals extending externally from the housing are assembled into the housing, each with a pair of offset tabs formed integrally therewith which, upon the terminal being inserted in through a slot in the housing, the tabs snap lock to recesses formed in the housing slots, preventing removal of the terminals from the housing. The present invention thus provides a user adjustable thermally responsive cycling switch assembly for a range burner which is simply and readily assembled by employing a subassembly of the thermally responsive switch and a preload spring which may include ambient compensating bimetal with the subassembly pivoted as a unit on the housing.

DETAILED DESCRIPTION

Figure 1:
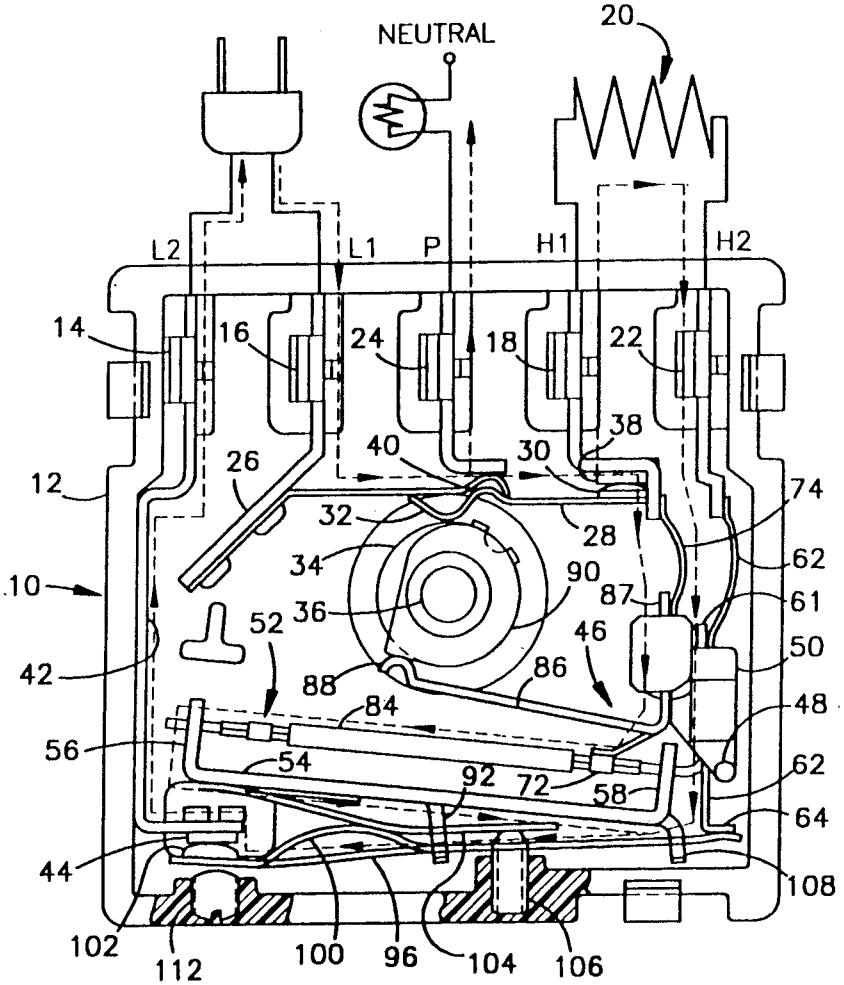
FIG. 1 is a plan view of the switch assembly of the present invention, having a snap action cycling switch and the heating element for the thermally responsive switch actuator electrically in parallel with the load connecting terminals.

Referring to FIGS. 1, the thermally actuated switch assembly is illustrated in one embodiment indicated generally at 10, and has a housing 12 with a first electrical connector terminal 14 connected to one side L2 of a power line. Spaced from terminal 14 is a second electrical terminal 16 connected to the opposite side L1 of the power line. A third connector terminal 18 is spaced remotely from terminal 16 and extends from the housing for connection to one side H1 of a range burner load indicated generally at 20. A fourth connector terminal 22 is provided spaced adjacent terminal 18, and terminal 22 is adapted for connection to the opposite side H2 of burner load 20. A fifth terminal 24 is provided disposed intermediate terminals 16 and 18, and is adapted for connection to an indicator lamp line P for indicating current flow between terminals 16 and 18.

The terminals 14, 16,24, 18,22 are inserted through the housing and extend externally therefrom, as will hereinafter be described in greater detail.

Terminal 16 has an appendage 26 extending inwardly in the housing; and, appendage 26 has attached thereto a contact blade 28 which extends therefrom in cantilever with an electrical contact 30 provided on the end thereof. Contact blade 28 has a cam follower 32 formed thereon for following a cam surface 34 provided on a user input shaft 36 journalled for rotation on the housing 12 and which extends outwardly therefrom.

Terminal 18 has the end formed at right angles with a stationary contact 38 attached thereto and which is disposed for making and breaking a circuit with contact 30 upon movement of the contact blade 28 by cam 34. The blade 28 also has formed thereon a secondary contact surface 40, which acts as a movable contact for making a circuit against a right angle bent portion of terminal 24 to provide current flow to the pilot line P when the switch contact blade is moved by cam 34 to the position shown in FIG. 1.

Terminal 14 has an appendage or extension 42 provided thereon and disposed along the wall housing 12, which extension 42 has the lower end thereof formed at right angles and with a stationary electrical contact 44 provided thereon.

Figure 5:
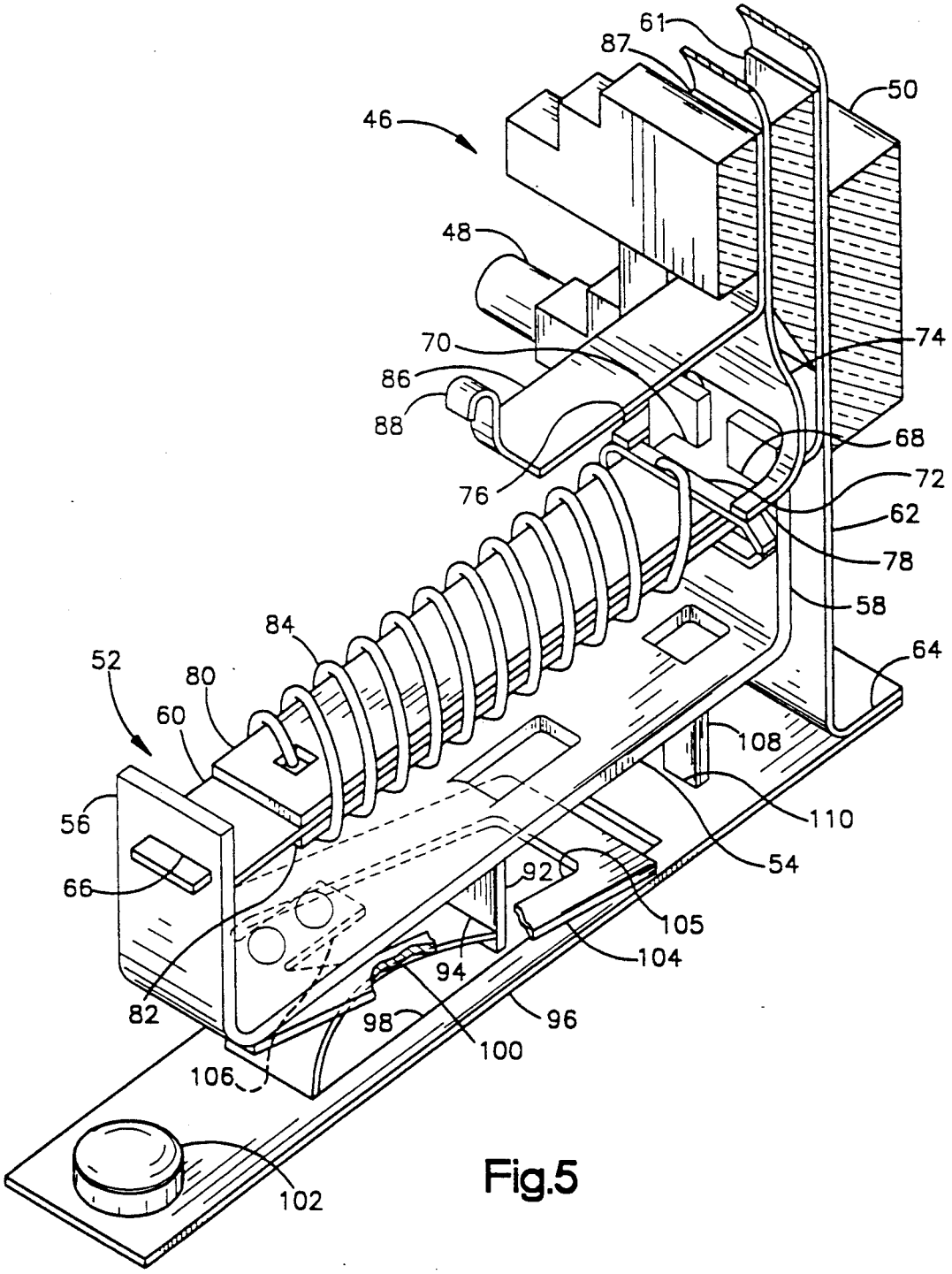
FIG. 5 is an enlarged axonometric view of the thermally responsive switch subassembly employing the snap action arrangement of FIGS. 1 and 2.

Referring to FIGS. 1 and 5, the thermally actuated switch blade assembly indicated generally at 46 is pivotally mounted on housing 12 by a pin or projection 48 provided on an insulating pivot block 50, with the pin 48 journalled in the housing 12.

The subassembly 46 gas a thermally responsive actuator means indicated generally at 52, which comprises a support bracket 54 with upturned end portions 56,58 formed or bent at right angles. An active bimetal actuator blade 60 extends in cantilever from the block 50 and has a generally right angle configuration with one end 61 thereof anchored in a slot provided in block 50 in contact with a jumper blade 62 which extends upwardly from the block 50, and also downwardly with a right angle flange 64 provided on the lower end thereof.

Bimetal blade 60 has a portion of the free end thereof received through a slot 66 provided in the end 56 of bracket 54. The other end 58 of bracket 54 is bifurcated and is registered in oppositely disposed slots 68,70 formed in the blade 60. A pair of layers 80,82 of insulating material are disposed on opposite sides of bimetal blade 60.

A conducting bar 72 is attached transversely across the end of bimetal blade 60 adjacent the bracket end 58. The bar 72 is wrapped around insulators 80,82 and secured by welding at the ends thereof.

A second jumper member 74 is received in a second slot in block 50 in spaced insulated relationship with the jumper 62; and, jumper 74 extends downwardly with the end thereof bifurcated to have spaced arms 76,78 thereof contacting the bar 72. Arms 76,78 are spot welded thereto to the bar 72 for providing electrical conduction therewith.

An electrically conductive heating coil 84 is wound the insulator 80,82 with one end thereof attached to the blade 60 in an electrically conductive manner as, for example, by spot welding or soldering. The other end of the coil 84 is attached to the bar 72 preferably by welding.

A preload blade 86, preferably also formed of bimetal material for ambient temperature compensation, is formed in a generally right angle, with one end thereof received in the slot formed in block 50 in contact with jumper 74. The free end of preload blade 86 extends outwardly from the block 50 in generally spaced parallel configuration with the blade member 60; and, preload blade 86 has a cam follower 88 formed on the free end thereof. Referring to FIG. 1, cam follower 88 is in contact with a second cam surface 90 provided on the user input shaft 60 and disposed axially adjacent cam surface 34.

Bracket 54 has a tab 92 punched therein intermediate the ends 56,58 and folded to extend downwardly therefrom; and, tab 92 has a recess or groove 94 formed transversely thereacross on one side thereof for registration therein as will be described below.

A switch contact blade member 96 has one end thereof attached to flange 64 of jumper 62, preferably by weldment. Blade member 96 has an aperture 98 formed therein to provide clearance for the tab 92. A tongue portion 100 is formed integrally therewith and bowed with the end thereof registered in recess 94 in tab 92. Tongue 100 thus forms a snap acting spring for blade 96. A contact 102 is provided on the end of blade 96 for movement therewith. Upon assembly of the pivot pins 48 of block 50 in the housing, contact 102 is disposed to make and break circuit with a stationary contact 44 upon snap acting movement of blade 96.

A calibration spring 104 has a tongue portion 106 formed on one end thereof and which tongue 106 is illustrated in dashed outline in FIG. 5 and is attached to bracket 54 near end 56; and, calibration spring 104 has a cutout therein for straddling tongue 100 and tab 92. In reference to FIG. 1, the calibration spring 104 is adjusted by a suitable screw 106 threaded in the housing.

Bracket 54 has a second tab 108 punched therein and adjacent the end 58 thereof; and, tab 108 is bent to extend downwardly from the bracket 54 and registers in a suitably formed aperture 110 provided in contact blade 96.

In the embodiment of FIG. 1, the upper end of jumper 74 is connected to the extension of load terminal 18; and, the upper end of jumper 62 is connected to an extension of load terminal 22. It will be understood that the path of the current is as shown in dashed outline in FIG. 1 from power lead L1 through terminal 16, blade 28, and contacts 30,38 through terminal 18, line H1 and the load 20 and return through line H2 and terminal 22. Current also flows from terminal 18 through jumper 74 to the bimetal blade 60 and heater coil 84, bracket 54, and contact blade 96, and contact 102. The current through the load flows through the terminal 22, jumper 62, and flows through the switch contact blade 96 at attachment flange 64 to thus give a parallel electrical connection to heater coil 84 with load 20 and series connection through contacts 102 and 44.

Figure 6:
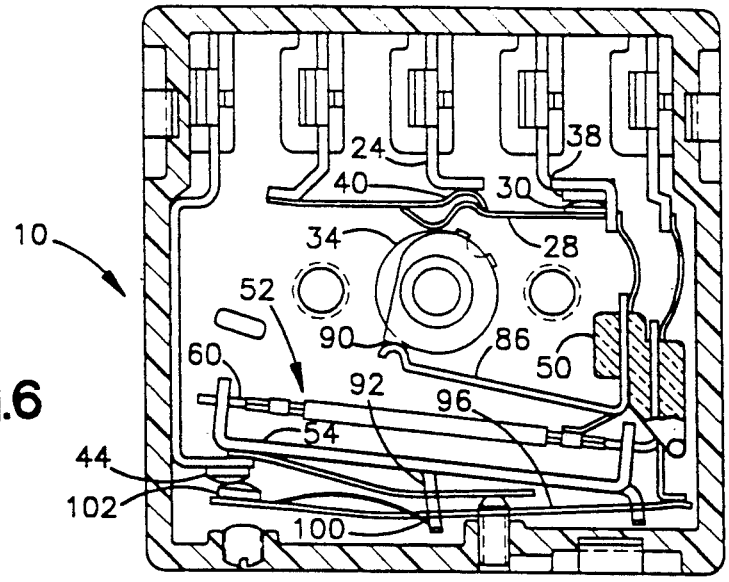
FIG. 6 is a view of the embodiment of FIG. 1, with the thermal actuator at the onset of current flow therethrough.

Referring to FIG. 6, the thermally responsive switch assembly 10 is shown in a condition in which the user has rotated cam 34 to a position raising contact blade 28 to a position closing contacts 30 and 38, and contact 40 on terminal 24. Preload and ambient compensating bimetal arm 86 has been moved to a position providing the desired preload torque on block 50 and current flows through the load and jumper 52 and through contacts 102,44, such that the thermal actuator 52 begins heating. In the position shown in FIG. 6, tang 92 has moved the snap switch tongue 100 to a downward position below the contact blade 96 to cause the tongue 100 to maintain the contacts 102,44 closed.

Figure 7:
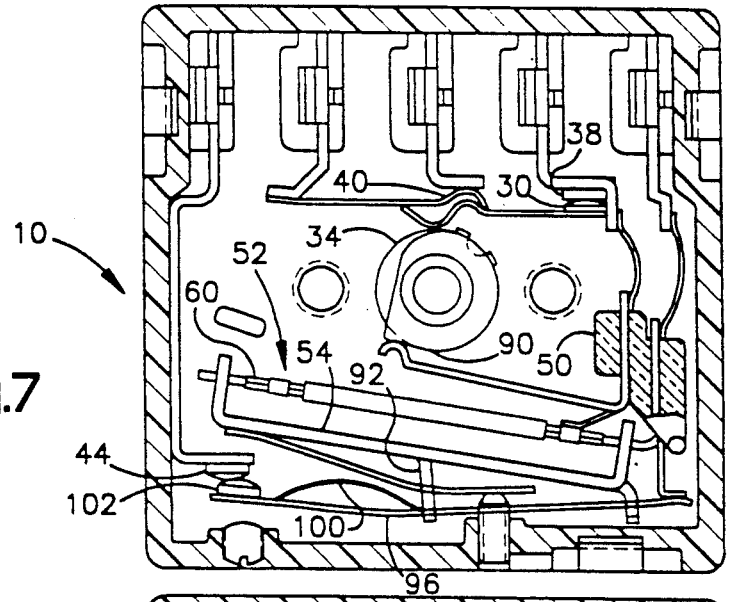
FIG. 7 is a view of the thermal actuator of FIG. 6 heated to a point approaching actuation of the snap switch.

Referring to FIG. 7, the thermal actuator 52 has continued to heat bimetal 60, raising the support bracket 54 and tang 92 to a position where the end of snap switch tongue 100 is just passing through blade 96; and, the contact blade is at a position of incipient opening. Yet, contacts 102,44 remain closed, and current continues through the load.

Figure 8:
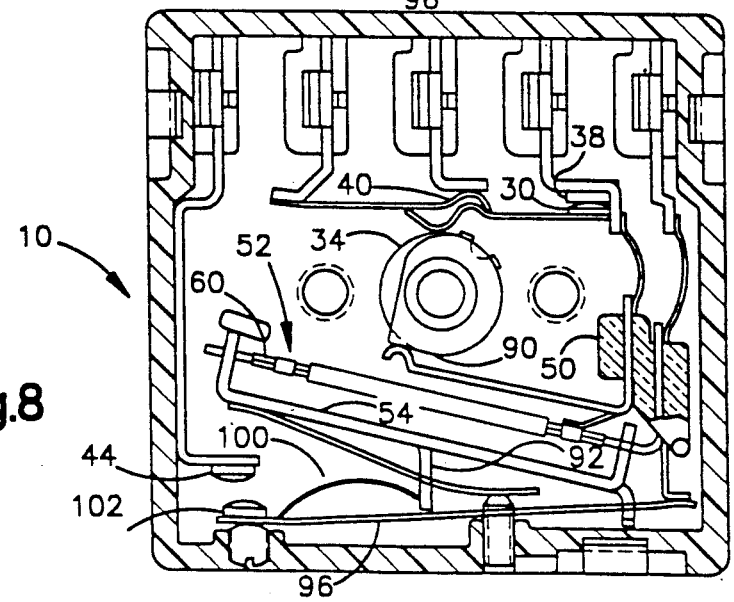
FIG. 8 is a view similar to FIG. 6, showing the thermal actuator in the fully heated state, wherein the snap switch has been actuated to open the load control contact.

Referring to FIG. 8, the thermal actuator 52 has further warped the bimetal blade 60 by an amount sufficient to raise support bracket 54 and tang 92 to a position where the end of tongue 100 is raised above contact blade 96, causing the blade 96 to toggle or snap downwardly, opening contacts 44,102.

It will be understood that when the circuit is broken between contacts 44,102, and current ceases to flow through the load, the thermal actuator cools and bimetal blade 60 cools, returning to the position shown in FIG. 6, reclosing the contacts 44,102. If the user has left the cam 34 in the position shown in FIG. 6, contacts 30,38 will be closed and current will again flow through the load, and the switch will cycle again until the thermal actuator 52 has caused contacts 44,102 to be broken.

Figure 2:
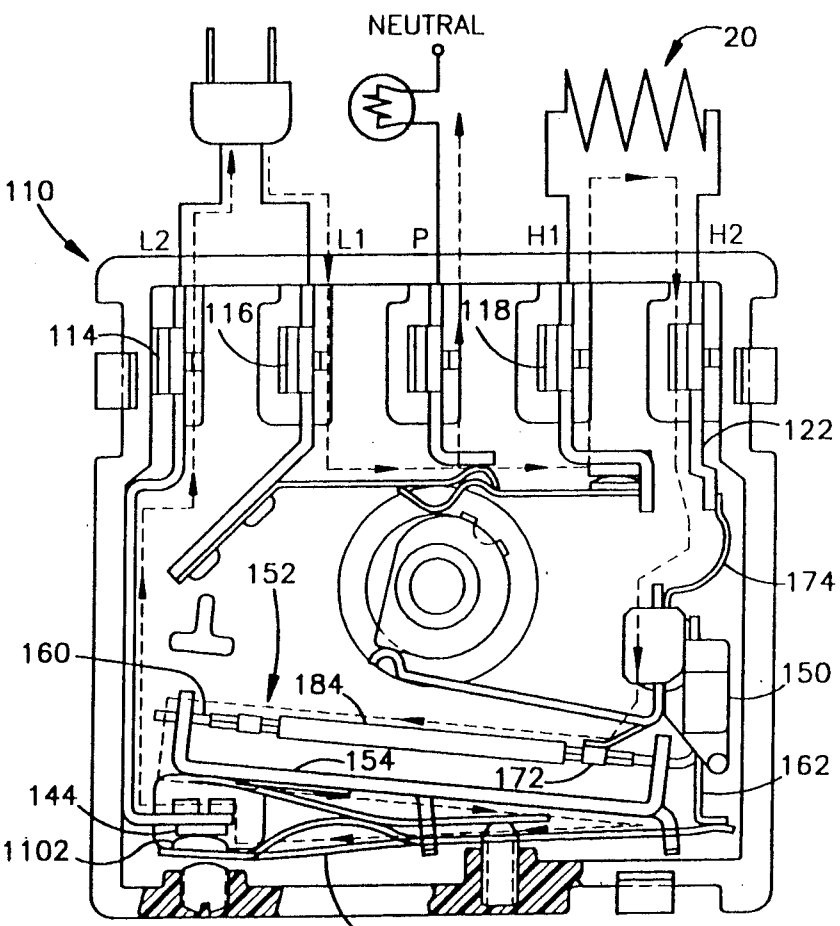
FIG. 2 is a view similar to FIG. 1, showing another embodiment employing the same snap acting cycling switch assembly as the FIG. 1 embodiment, but with the heater connected electrically in series with the load connecting terminals.

Referring to FIG. 2, an alternate embodiment of the invention is illustrated, similar to the embodiment of FIG. 1, and denoted generally at 110. The embodiment of FIG. 2 is otherwise identical to the embodiment of FIG. 1, except that jumper 174 is connected to the fourth housing terminal 122, which is adapted for connection to the load return line H2. In the embodiment 110 of FIG. 2, the jumper 162 is cut off at the top of pivot block 150, and does not extend to connect to the load terminal. Thus, the embodiment 110 has the heater of the thermal actuator series connected with the load. The path of the load current is indicated in dashed outline in FIG. 2, and returns from a load 20 through terminal 122, jumper 174, to the thermal actuator 152, through bracket 154 and contact blade 196, and contacts 144,1102, and terminal 114 to the opposite side L2 of the power line.

Figure 3:
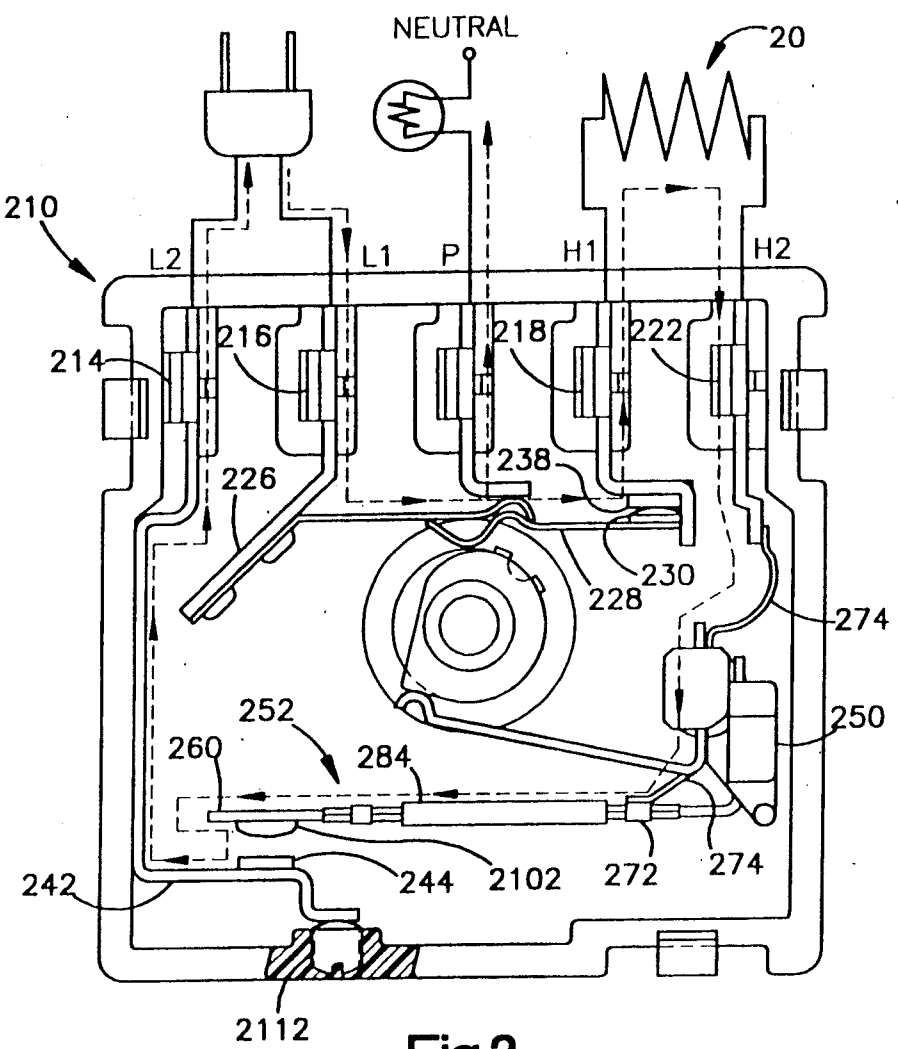
FIG. 3 is a view of another embodiment employing a contact directly on the thermally responsive actuator for effecting slow movement of the movable switch contact with the thermal actuator heater connected electrically in series with the load terminals.

Referring to FIG. 3, another embodiment of the invention is shown generally at 210 wherein the thermal actuator for the load controls contacts 2102 and 244 comprises a slow make and break mechanism, with the snap acting mechanism eliminated. In the embodiment of FIG. 3, the bimetal blade 260 has the movable contact 2102 attached directly thereto and the bimetal 260 is in series with load line H2 via contact terminal 222 and jumper 274, which extends from the pivot block 250 and connects to terminal 222. The load is connected via line H1 through terminal 218, arming switch contacts 238,230, contact blade 228, and terminal 216 to the opposite side of L1 of the powerline.

Stationary contact 244 is mounted on bus strip 242, which forms a part of terminal 214, which is adapted for connection to the opposite side L2 of the powerline. If desired, bus strip 242 may extend beyond contact 244 with the end thereof adjustable by a screw 2112 provided through the housing.

The current path in the embodiment of FIG. 3 is indicated by dashed outline; and, it will be understood that the arrangement of the arming switch and indicator lamp line are otherwise identical to the embodiment of FIG. 1.

Figure 4:
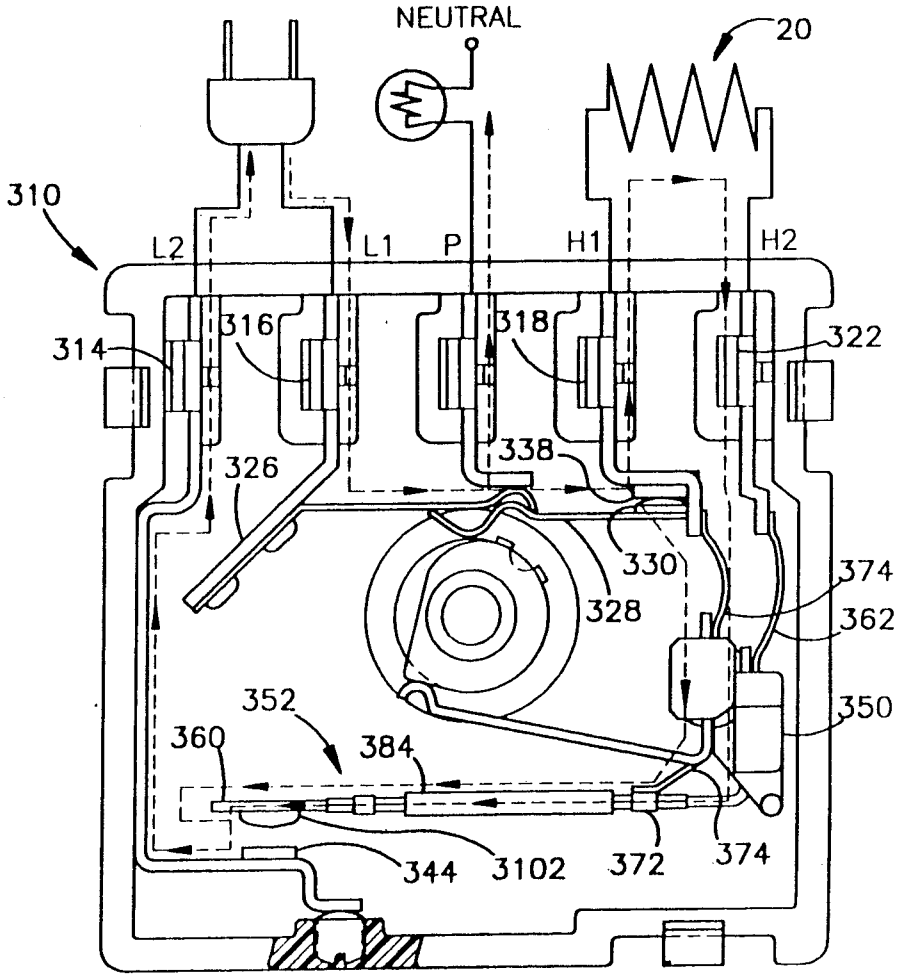
FIG. 4 is a view similar to FIG. 3 of another embodiment employing the slow moving contact arrangement of FIG. 3, with the heater and movable contact electrically in parallel with the load terminals.

Referring to FIG. 4, another embodiment of the invention, similar to that of FIG. 3 is denoted generally at 310 as having the bimetal blade 360 elecrically in parallel with the thermal actuator 352. Bimetal blade 360 is in contact with jumper strip 362 in pivot block 350; and, the jumper strip 362 extends upwardly therefrom to connect with connector terminal 322 which is adapted for connection through H2 to one side of the burner load 20.

The jumper 374 is connected to the thermal actuator 352 through pivot block 350 and jumper 374 extends upwardly therefrom to load terminal 318 and lead line H1 of load 20. The current flow shown in dashed line in FIG. 4 is through both the thermal actuator 352 and the blade 360 and flows through movable contact 3102 attached to the blade 360 and through stationary contact 344 and terminal 314 in a manner similar to the embodiment of FIG. 3.

It will be understood that the embodiments of FIGS. 1 and 4 permit the use of a high resistance for the heater coil 84,384 for the thermally responsive actuator. The desired resistance of the heater coil is thus less sensitive to variations in the material and manufacturing.

Figure 9:
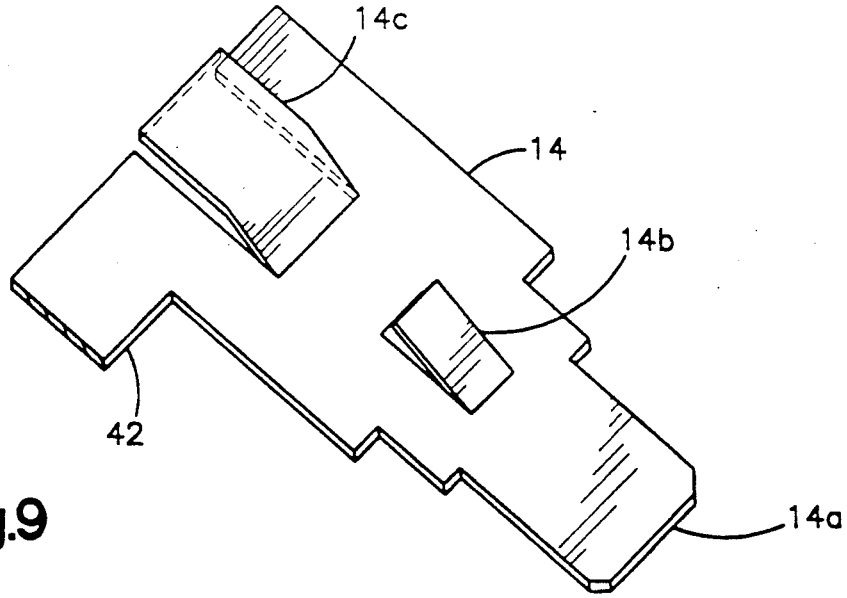
FIG. 9 is a view of the stamped connector terminal for the housing.
Figure 10:
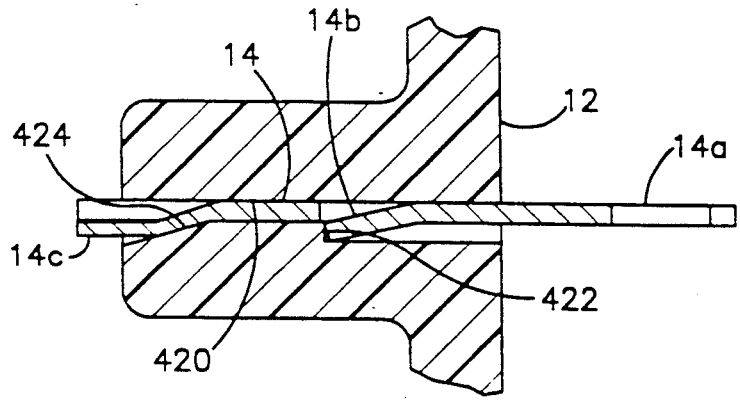
FIG. 10 is a view of the terminal of FIG. 9 installed in the housing.

Referring to FIGS. 9 and 10, another aspect of the present invention is illustrated wherein the details of a typical one of the contact terminals 14.16.18.22.24 is illustrated with a terminal 14, wherein the portion 14*a* which extends outwardly of the housing has a reduced transverse section from the remaining portion of the terminal.

The terminal 14 has an offset tab 14*b* formed by punching or stamping, disposed at the base of the portion 14*a*. A second offset tab 14*c* is provided at the end of the terminal opposite the portion 14*a*.

Referring to FIG. 10, the terminal is shown received in a slot 420 provided in the housing, which slot has a recess or shoulder 422 formed therein, against which the edge of tab 14*b* is snap locked upon insertion of terminal 14 into the slot 420 from the left with respect to FIG. 10. A second recess 424 having a chamfered, or angled, edge is provided at the left or interior end of the slot 420 and the face of tab 14*b* is registered thereagainst to retain the tab 14*c* in contact with shoulder 424. Once the terminal is inserted into the housing slot 420.

Figure 11:
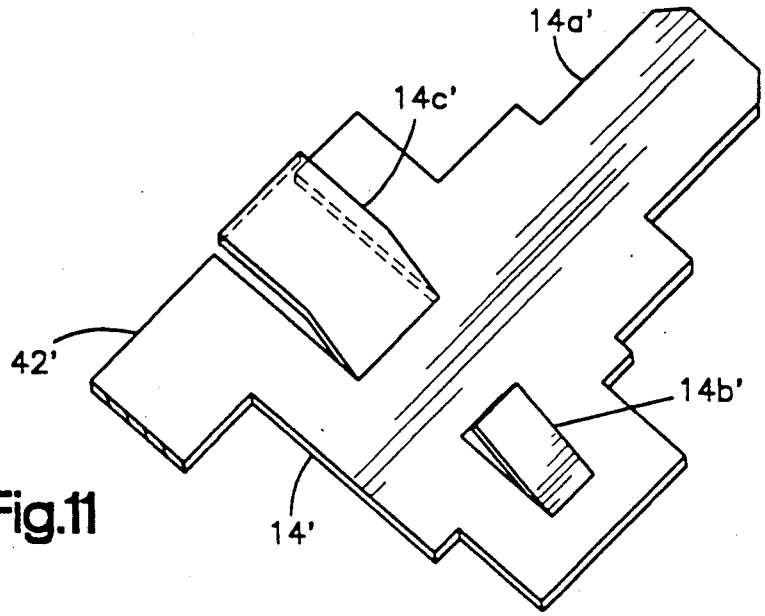
FIG. 11 is a view similar to FIG. 9 of an alternate connector terminal for the housing.

Referring to FIG. 11, an alternate embodiment of the connector terminal 14' is shown which has the external portion 14*a'* oriented at right angles to the configuration of FIG. 9. The terminal of FIG. 11 has first and second offset tabs 14*c'* and 14*b'* punched therein in a manner similar to the tabs of the FIG. 9 embodiment. The terminal of FIG. 11 is otherwise installed in the same manner as shown in FIG. 10, but provides for the external portion 14*a'* to extend from the adjacent side of the housing, as does the terminal 14*a* of the FIG. 9 embodiment.

The present invention thus provides a unique thermally responsive cycling switch for a range burner which has the cycling control switch blade mechanism and thermally responsive actuator formed as a subassembly on a block pivotally mounted in the switch housing with integrally attached jumpers for connection to the stationary terminals in the switch housing. The subassembly includes a preload blade having ambient temperature compensation properties. The subassembly thus simplifies the construction and reduces the manufacturing costs of the thermally responsive cycling switch assembly.

In another unique aspect of the invention, connector terminals are inserted from the interior of the switch housing into slots and are snap locked in the slot by integrally formed tabs with the connector terminal portion extending exteriorly of the switch housing.

Although the invention has been described hereinabove with respect to the embodiments illustrated, it will be understood that the invention is capable of modification and variation, and is limited only by the following claims.

We claim:

1. A thermally actuated switch assembly for heater load connection comprising:

(a) housing structure defining a first and a second power line connector terminal and a third and fourth heater load connector terminal and circuit means connecting said second and third connector terminal;

(b) a stationary contact electrically connected to said first connector terminal;

(c) a thermally responsive cycling mechanism, including a member mounted for pivotal movement on said housing structure, said mechanism including a contact blade having a movable contact thereon disposed upon movement for making and breaking a circuit with said stationary contact, and including a resistance member electrically connected in circuit with at least one of said third and fourth connector terminals, said resistance member operable upon a certain wattage of current flow therethrough to become heated and effect movement of said contact blade to break the circuit with said stationary contact, whereupon said current ceases to flow through said resistance member, which thereupon cools and effects remaking of said circuit with said movable contact thereby cycling current to the load; and, (d) adjustable means operable upon user actuation to adjust the initial position of said cycling mechanism.

2. The terminally actuated switch assembly defined in claim 1, wherein said cycling mechanism includes a snap action device for effecting said movement of said blade member.

3. The assembly defined in claim 1, wherein said adjustable means includes a user rotatable cam with a resilient cam follower.

4. The assembly defined in claim 1, wherein said circuit means includes a user actuated switch series connected between said second and third connector terminals.

5. The assembly defined in claim 1, wherein said circuit means includes a user operated switch series connected between said second and third connector terminals; and, said adjustment means is operable for effecting actuation and deactuation of said user actuated switch.

6. The switch assembly defined in claim 1, wherein said cycling mechanics comprises a subassembly of a resilient cam follower member mounted on said pivoted member, for operably contacting said adjustable means, a contact blade member and a bi-metal member heat warped by said resistance member.

7. The assembly defined in claim 1, wherein said cycling mechanism comprises a subassembly having a resilient preload arm operably contacting said adjustable means and with said conductive member formed integrally with said contact blade.

8. The assembly defined in claim 1, wherein said housing includes a fifth connector terminal electrically connected to said circuit means and adapted for connection to an indicator.

9. The assembly defined in claim 1, wherein said cycling mechanism includes an elongated support member, a calibration spring arm attached to one end thereof with said contact blade attached to the opposite end thereof, and including a snap acting spring with said calibration spring applying a preload to said snap acting spring.

10. A cycling mechanism for a thermally actuated load switch comprising:

(a) a pivot block means adapted for being pivotably mounted on said switch;

(b) as adjustment arm having one end thereof rigidly anchored to said block means and extending therefrom in cantilever;

(c) a resilient contact blade having one end anchored to said block means and extending in cantilever therefrom, said contact blade having an electrical contact provided on the free end thereof;

(d) electrical heater means associated with said pivot block means and movable therewith, said heater means operable, upon flow of a certain wattage of current therethrough, to effect movement of said electrical contact with respect to said pivot block means; and (e) electrical terminal means connected with said contact blade and said heater means and adapted for external circuit connection therewith.

11. The cycling mechanism defined in claim 10, further comprising a support member mounted on said blade member with said heater means mounted thereon.

12. The cycling mechanism defined in claim 10, wherein said contact blade includes a snap action spring member.

13. The cycling mechanism defined in claim 10, wherein contact blade includes a snap action spring member; and, said heater means includes a support member with a heater thereon, said member having one reaction end of said snap action spring registered thereon for effecting over-center movement thereof upon flow of said certain wattage of current.

14. The cycling mechanism defined in claim 10, wherein said heater means includes a support member with a heater thereon, said support member having one reaction end of a calibration spring in contact therewith, with the opposite reaction end adapted for contacting an adjustment means.

15. The cycling mechanism defined in claim 10, wherein said contact blade includes said heater means.

16. The cycling mechanism defined in claim 10, wherein said contact blade includes a spring portion movable over-center for effecting a snap action movement; and, said heater means includes a member operable to move said spring portion in said over-center movement.

17. A thermally actuated switch assembly for cycling current to a load comprising:

(a) housing means;

(b) a swing switch means adapted for connection to one side of a power line and operable upon user actuation to make connection with a first load connecting terminal;

(c) a second load connecting terminal isolated from said first terminal;

(d) insulated block means mounted for pivotal movement on said housing means;

(e) user adjustable means operable to apply a reload torque in one direction on said block means;

(f) a stationary electrical switch contact mounted on said housing means and adapted for connection to the side of a power line opposite said one side;

(g) a first resilient flexible electrically conductive lead means connected between one of said first and second load terminals and said block means;

(h) a switch contact blade having one end thereof anchored to said block means with a movable contact thereon said one end and disposed adjacent said stationary contact;

(i) thermally responsive actuator means operable upon being heated and cooled to cycle said contact blade between a position making and a position breaking circuit with said movable and stationary contacts;

(j) heater means connected in circuit with said flexible lead means and said movable contact means and operable upon making of said movable and stationary contact means and current flow therethrough to effect heating of said actuator means;

(k) calibration means operable for adjustably biasing said contact blade; and, (l) second electrically conductive means connecting said first lead means with one of said second and first load terminals and said blade means, wherein said block means, said contact blade, movable contact, said first and second means, said calibration means, and said user adjustable preload means are assembled as a subassembly for said pivotal mounting on said housing means.

18. The switch assembly defined in claim 10, wherein said contact blade is formed of bi-metal material.

19. The switch assembly defined in claim 10, wherein means adjustably applying said preload to said block means includes ambient temperature compensation means.

20. The switch assembly defined in claim 10, wherein said contact blade arm means includes snap acting means for effecting movement of said movable contact.

21. An electrical control assembly comprising:

(a) housing defining a wall portion;

(b) circuit means mounted in solid housing means including a set of electrical contacts operable to perform an electrical control function;

(c) a plurality of apertures formed in said wall means;

(d) detent means formed in said housing means adjacent said aperture;

(e) a connector terminal formed from generally thin flat stock and having (i) a first resilient tab formed integrally therewith and offset therefrom;

(ii) a second tab spaced from said first tab formed integrally therewith and offset therefrom;

(iii) a guide portion received in said aperture;

(iv) a blade portion extending externally through said aperture;

(f) said housing means defining a channel having a detent surface formed therein and a stop surface spaced from said detent surface, wherein said detent surface and said stop surface are generally aligned with said aperture;

(g) said terminal assembled to said housing means by deflecting said first tab over said stop surface to engages said detent surface wherein said second stab is biased against said stop surface retaining said terminal in said housing means with said blade portion extending outwardly therefrom and said guide portion received in said aperture; and (h) lead means connecting said connector terminal to said switch means.

22. The assembly defined in claim 21, wherein said guide portion forms a portion of said blade portion.

23. The assembly defined in claim 21, wherein said guide portion and said blade portion are disposed generally at right angles.

24. The assembly defined in claim 21, wherein said circuit means includes switching means operable to make and break a circuit through said connector terminal.

25. The assembly defined in claim 21, wherein said circuit means includes means operable upon current flow therethrough to cyclically make and break a set of contacts.

* * * * *